US010919667B2

(12) United States Patent
Cziraky

(10) Patent No.: US 10,919,667 B2
(45) Date of Patent: Feb. 16, 2021

(54) NESTING STORAGE CONTAINER

(71) Applicant: CRAYOLA, LLC, Easton, PA (US)

(72) Inventor: David A. Cziraky, Bethlehem, PA (US)

(73) Assignee: Crayola LLC, Easton, PA (US)

( * ) Notice: Subject to any disclaimer, the term of this patent is extended or adjusted under 35 U.S.C. 154(b) by 173 days.

(21) Appl. No.: 15/678,980

(22) Filed: Aug. 16, 2017

(65) Prior Publication Data

US 2018/0282021 A1 Oct. 4, 2018

Related U.S. Application Data

(60) Provisional application No. 62/480,067, filed on Mar. 31, 2017.

(51) Int. Cl.
*B65D 21/02* (2006.01)
*B65D 25/28* (2006.01)

(52) U.S. Cl.
CPC ..... *B65D 21/0233* (2013.01); *B65D 25/2897* (2013.01)

(58) Field of Classification Search
CPC .... B65D 21/0233; B65D 21/02; B65D 21/00; B65D 21/04; B65D 21/068
USPC ..... 220/516, 515, 518, 519, 520, 771
See application file for complete search history.

(56) References Cited

U.S. PATENT DOCUMENTS

| | | | | |
|---|---|---|---|---|
| 3,083,888 | A * | 4/1963 | Miller | B65D 21/0233 229/400 |
| 3,114,495 | A * | 12/1963 | Grooms | B65D 5/103 206/519 |
| 3,779,447 | A * | 12/1973 | Bemiss | B29C 33/10 229/117.35 |
| 3,938,691 | A * | 2/1976 | Dumas | B65D 11/26 220/780 |
| D710,614 | S | 8/2014 | Meersschaert | |
| D718,936 | S | 12/2014 | Sanz et al. | |
| D728,239 | S | 5/2015 | Sanz et al. | |
| 9,119,611 | B2 | 9/2015 | Super et al. | |
| D783,856 | S | 4/2017 | Super et al. | |
| 2017/0305632 | A1* | 10/2017 | Brown | F25D 3/08 |

OTHER PUBLICATIONS

Non-Final Office Action dated Aug. 7, 2019 in Design U.S. Appl. No. 29/662,536, 5 pages.
Notice of Allowance dated Nov. 29, 2019 in Design U.S. Appl. No. 29/662,536, 7 pages.

* cited by examiner

*Primary Examiner* — Jerfrey R Allen
(74) *Attorney, Agent, or Firm* — Shook, Hardy & Bacon L.L.P.

(57) ABSTRACT

Embodiments of the invention are directed to a nesting storage container comprising: a plurality of upright walls surrounding an internal cavity; at least one de-nesting feature in the internal cavity, said de-nesting feature comprising an offset height with respect to a bottom surface of the internal cavity; and at least one handle having a concave handle offset oriented along a vertical axis of at least a portion of at least one of the plurality of upright walls.

12 Claims, 8 Drawing Sheets

NESTING STORAGE CONTAINER

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief and at a high level, this disclosure describes, among other things, a container configured for nesting with another container. In some aspects, the storage container provides a standoff structure for de-nesting the container against a surface of an adjacent container.

DESCRIPTION OF THE DRAWINGS

Illustrative embodiments of the invention are described in detail below with reference to the attached drawing figures, and wherein.

DETAILED DESCRIPTION

Figure 1:
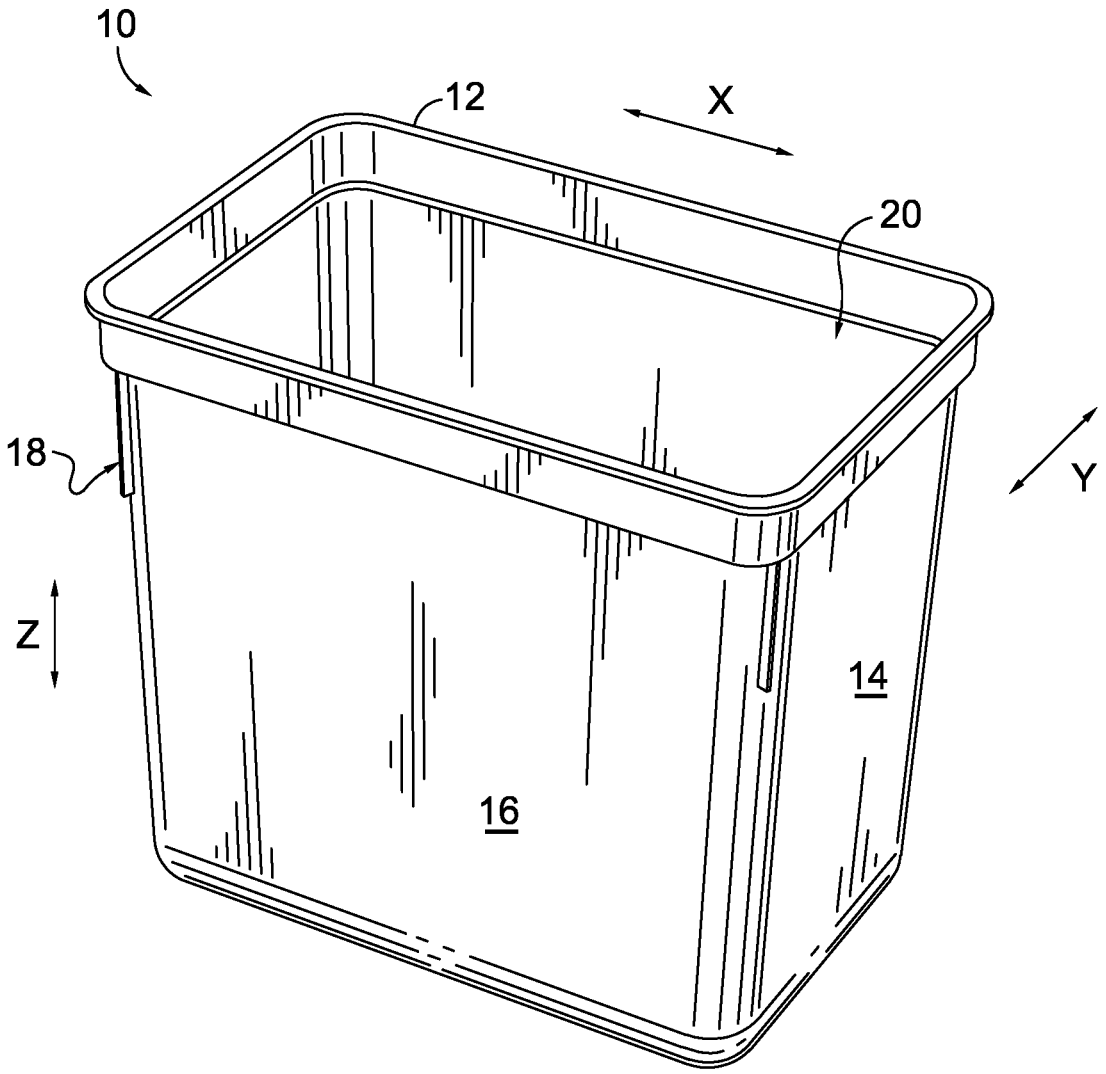
FIG. 1. PRIOR ART
FIG. 1 depicts a perspective view of an exemplary prior art storage container.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Various embodiments of the invention provide a container configured for nesting with another container. In some aspects, the storage container provides a standoff structure for de-nesting the interior of one container against an exterior surface of an adjacent container. Such de-nesting feature may be positioned at a particular location on the interior of the container, such as a bottom surface, and may extend into an interior cavity of the container at a particular height, such as a minimum height required to elevate the nested container within the cavity of the enclosing container while maintaining separability of the two containers. In further aspects, the de-nesting feature may be positioned within the internal cavity of the container at a particular orientation, such as the corners of the container.

Additionally, opposing side walls of the container may include a handle offset feature that facilitates nesting and de-nesting of containers stacked together, based at least in part on creating a threshold separation between the walls of the adjacent containers. Further, such separation may be carried along a threshold height with respect to the sides of the container. The handle offset feature of each container may, in some aspects, extend along a portion of the sides of the container, engaging against an adjacent container handle offset. As such, a handle offset feature may have an internal, concave shaping towards the internal chamber of the container. Further, upon nesting the walls of a first container inside a second container, the external surface of such handle offsets may be positioned next to the internal surface of the adjacent handle offsets.

Embodiments of the invention further relate to a handle structure formed at an upper end of the handle offset between an outer edge of the container and a concave shape of the handle offset. In further aspects of the invention, a compressed stacking and/or nesting orientation between two or more storage containers may be facilitated based a structure and/or function of the de-nesting structures, a structure and/or function of the handle offsets, or a combination of structure and/or function of one or more threshold-height, de-nesting structures and one or more concave handle offsets.

Accordingly, embodiments of the invention include, among other things, a nesting storage container comprising: a plurality of upright walls surrounding an internal cavity; at least one de-nesting feature in the internal cavity, said de-nesting feature comprising an offset height with respect to a bottom surface of the internal cavity; and at least one handle having a concave handle offset oriented along a vertical axis of at least a portion of at least one of the plurality of upright walls.

Embodiments of the invention also include a stackable storage container comprising: a plurality of vertical walls surrounding a cavity, wherein a first wall of the plurality of vertical walls is directly adjacent a second wall of the plurality of vertical walls; at least one de-nesting feature inside the cavity, said at least one de-nesting feature coupled to the first wall and the second wall; and at least one handle comprising a concave handle structure along at least a portion of the first wall.

In further aspects, a nesting storage container system for removably coupling multiple storage containers is provided. The container system includes a first nesting container having a first plurality of vertical walls surrounding a first internal cavity and a first bottom surface, said first nesting container comprising: a first handle having a vertical handle offset oriented concave to the first internal cavity on a first wall of the first plurality of vertical walls; and a first de-nesting feature on the first bottom surface of the first internal cavity, said first de-nesting feature coupled to the first wall proximate the vertical handle offset. The storage container further includes a second nesting container having a second plurality of vertical walls surrounding a second internal cavity and a second bottom surface, said second nesting container comprising: a second handle having a vertical handle offset oriented concave to the second internal cavity on a second wall of the second plurality of vertical walls; and a second de-nesting feature on the second bottom surface of the second internal cavity, said second de-nesting feature coupled to the second wall proximate the vertical handle offset, wherein upon positioning the second nesting container inside the first internal cavity of the first nesting container, the second bottom surface is spaced a threshold distance from the first bottom surface of the first nesting container based on one or more of the following: a height of the first nesting feature; a dimension of the vertical handle offset of each of the first handle and the second handle; and a threshold spacing between the first plurality of vertical walls and the second plurality of vertical walls.

Figure 2:
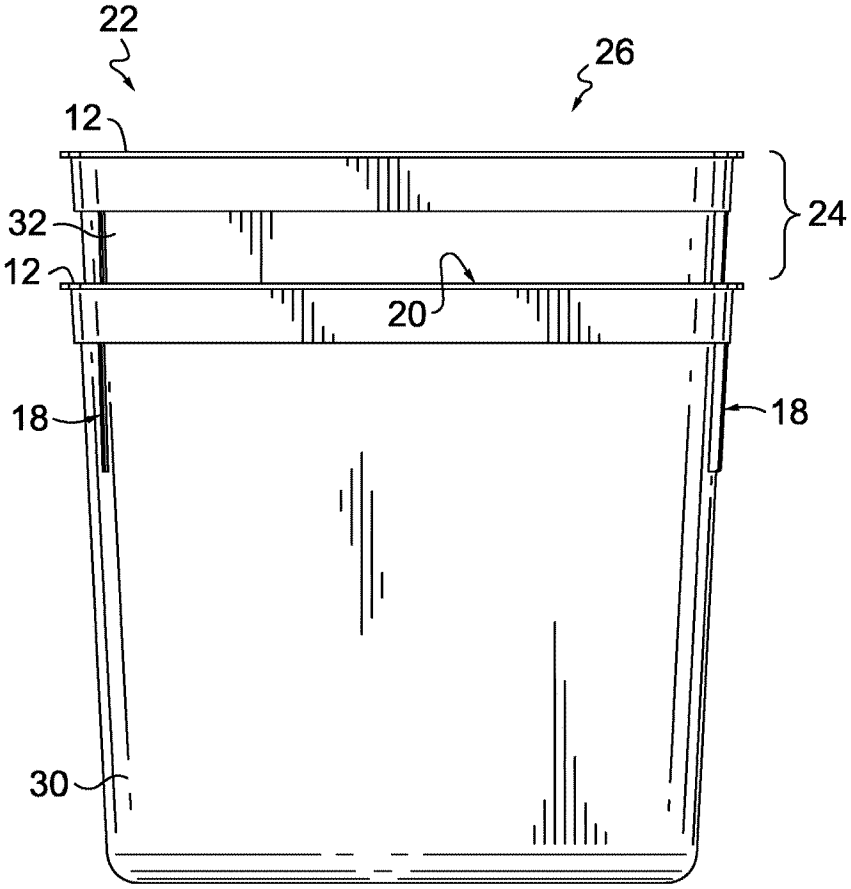
FIG. 2. PRIOR ART
FIG. 2 depicts a front view of an exemplary pair of nested prior art storage containers.

Accordingly, with reference to the exemplary FIGS. 1-2, a prior art storage container 10 is depicted as both a single container, and as a nested container stacked with an adjacent, prior art storage container 10. For example, in FIG. 1, the exemplary prior art storage container 10 includes a container body 12 having upright container walls along a z axis, including upright side walls 16 oriented along the x axis and upright end walls 14 oriented along the y axis. As shown in FIG. 1, the exterior of the container body 12 includes nesting lugs 18 that generate standoff against adjacent prior art storage containers 10. Accordingly, the internal cavity 20 of the container body 12 may form a vacuum against an external surface of a coupled/stacked prior art storage container 10, when nested together to store multiple storage containers 10.

In one aspect, as shown in FIG. 2, a nested orientation 22 between two container bodies 12 includes an offset height 24 at an upper end 26 opposite the lower end 28 of such paired, nested orientation 22. In some aspects, the internal cavity 20 of the first container 30 receives at least a portion of the second container 32, with nesting lugs 18 separating the upper end 26 of the second container 32 from the lower end 28 of the first container 30. The resulting offset height 24 may correspond to the nesting lug 18 displacing the second container 32 from an internal cavity 20 of the first container 30. In some aspects, a material of the container body 12 may further impact the separability of stacked container bodies 12, such as a polypropylene material molded into a configuration similar to that depicted in FIGS. 1-2. Such nesting lugs 18 or standoffs may be provided to help prevent nested storage containers 12 from "sticking" together, separating the interior of one container from the exterior of another container. In some aspects, such "sticking" may be a result of a partial vacuum formed when one container is nested into another, so the prior art storage containers 10 include ribbed features, or other structures, proximate an upper end of the container to maintain the nested container at a particular height within the cavity of the enclosing container.

Figure 3:
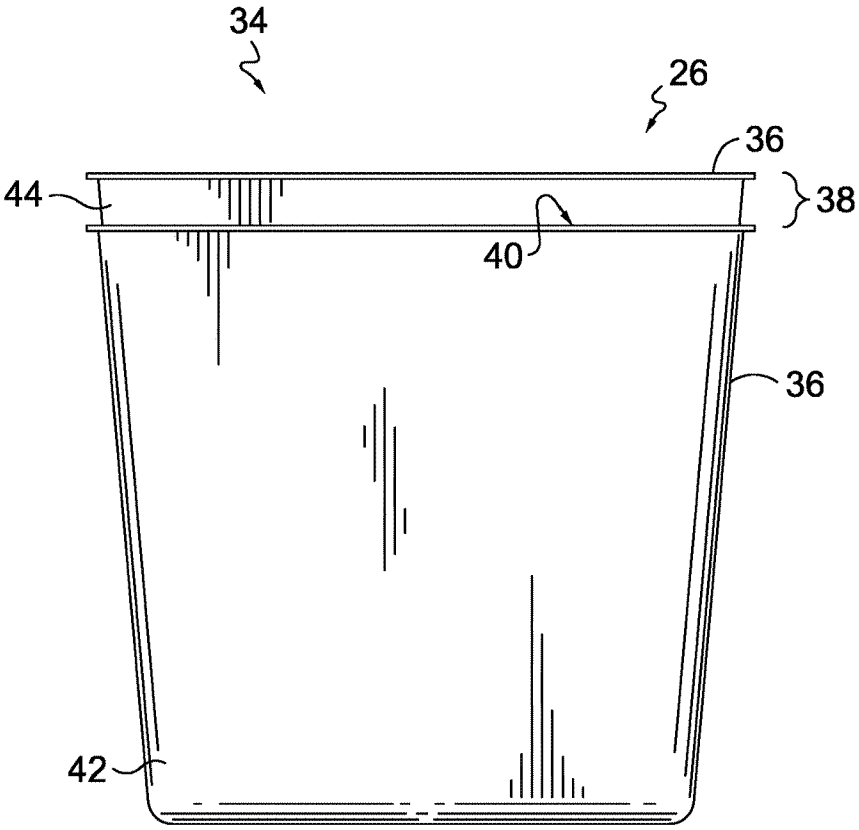
FIG. 3 depicts a front view of an exemplary pair of nested storage containers according to an embodiment of the invention.

In contrast to the external ribbing offsets (nesting lugs 18) and higher offset height 24 of the stacked prior art storage containers 10, embodiments of the invention are directed to a storage container having internal standoff features and a reduced offset height, as shown in FIG. 3. For example, the nesting storage container 34 includes a container body 36 that when stacked inside another container body 36, has a reduced offset height 38. In particular, the stacked orientation in FIG. 3 depicts a shorter offset height 38 as compared to the taller offset height 34 of FIG. 2. As such, between the upper end 26 and the lower end 28 of nested storage container bodies 36, less vertical space is consumed, and the internal cavity 40 of the first storage container 42 is configured to receive the external surface of the second storage container 44 without the need for external standoff features on the outside of the second storage container 44. In one aspect, based on a difference in offset heights 24 and 38, the claimed invention may be utilized to stack and/or nest multiple additional storage containers within a same vertical space as the prior art storage container. For example, between two and three times the number of storage containers may be stacked together in the same vertical space as the number of prior art containers filling the same space.

Accordingly, aspects of the invention are directed to a nesting storage container 46 having a container body 36 with upright side walls 58 and end walls 60 in a generally vertical orientation with respect to the z axis. In some aspects, the container body 36 includes an internal chamber 40 having a volume corresponding to the dimensions of the combined side walls 58, end walls 60, and bottom 62. Embodiments of the invention include various materials for forming the container body 36, such as an injection-molded material formed into one or more portions of the container body 36. For example, the container body 36 may be an injection-molded hardening material, such as an injection-molded polypropylene resin for forming the nesting storage container 46.

Figure 4:
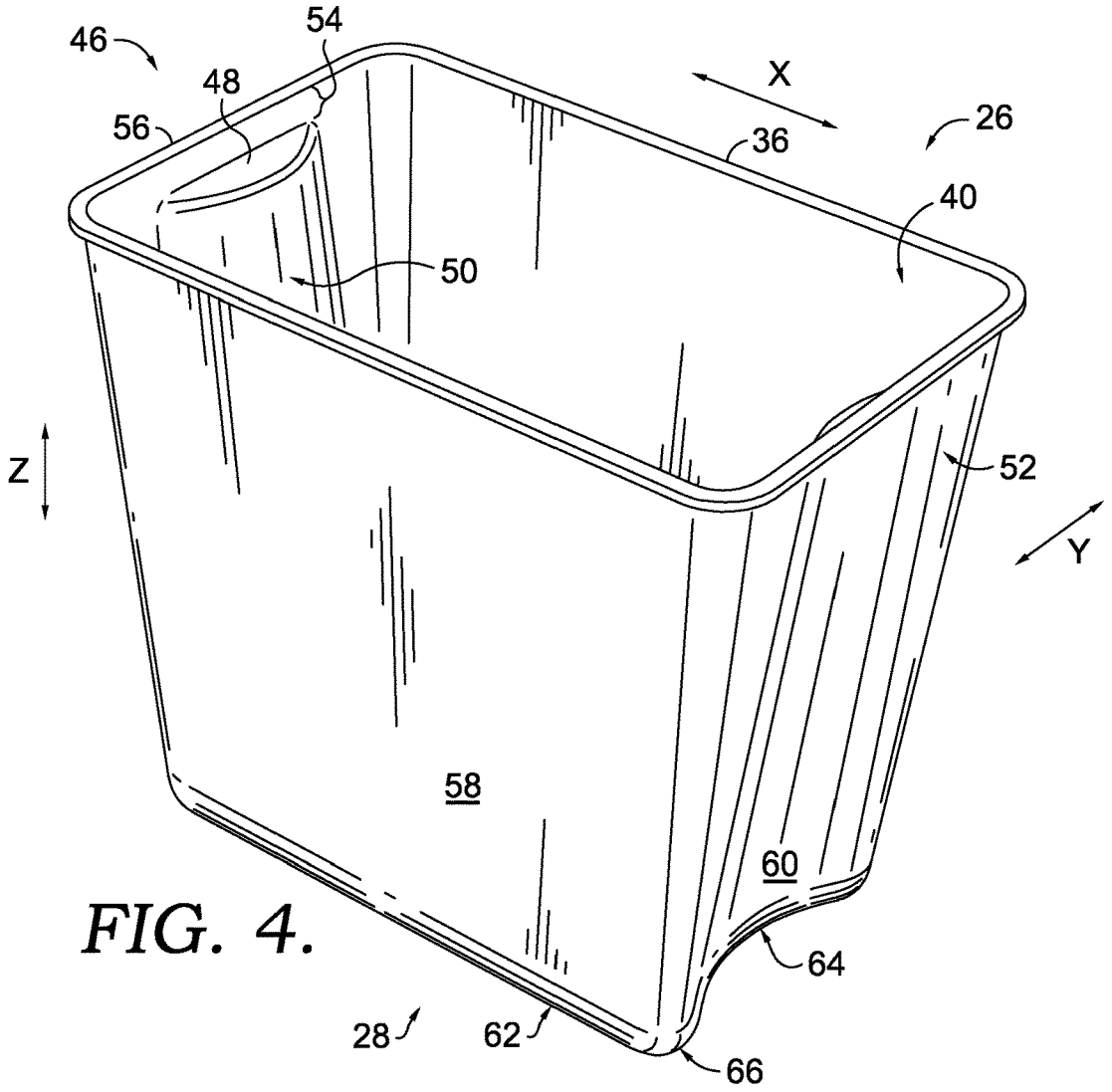
FIG. 4 depicts a front view of an exemplary storage container according to an embodiment of the invention.

In one embodiment of the invention, the container body 36 includes a pair of opposed end walls 60 having a handle 48 corresponding to a concave handle offset 50. In some aspects, the concave handle offset 50 is formed toward the internal chamber 40, with the handle 48 formed at a threshold distance 54 from the upper edge 56 of the container body 36. In some aspects, the concave handle offset 50 extends from the handle 48, downward toward the lower end 28. As shown in FIG. 4, the outer surface 52 of the concave handle offset 50 extends down the end wall 60 toward the arcuate edge 64 proximate the container bottom 62.

In further embodiments, although shown in the exemplary embodiments as being displaced a threshold distance 54 from the upper edge 56, in some aspects, the concave handle offset 50 may be oriented along the upper edge 56, to the lower, arcuate edge 64 while maintaining a handle 48 at or near the upper edge 56. Further, in some embodiments, the handle 48 and corresponding handle offset 50 may be oriented at any position along the z axis, with respect to each end wall 60. When in a nested configuration, the outer surface 52 of each handle offset 50 is positioned adjacent an internal surface of a handle offset 50 within the internal chamber 40, according to embodiments of the invention. In further aspects, an arcuate edge 64 may be formed along the container bottom 62 along a portion of the container between the container corners 66. When one or more containers are nested within each other, the space formed between the concave offset 50 of an internal container and the arcuate edge 64 of an external container may serve to further prevent formation of a vacuum the internal container and the external container. More specifically, the tapered shape of the container bodies 12 and the curvature of the concave offset 50 of the internal container and the arcuate edge 64 of the external container creates a pathway for air to escape the container bottom 62. Therefore, the vacuum that would be formed between containers not having concave offsets 50 and arcuate edges 64 is negated.

Figure 5:
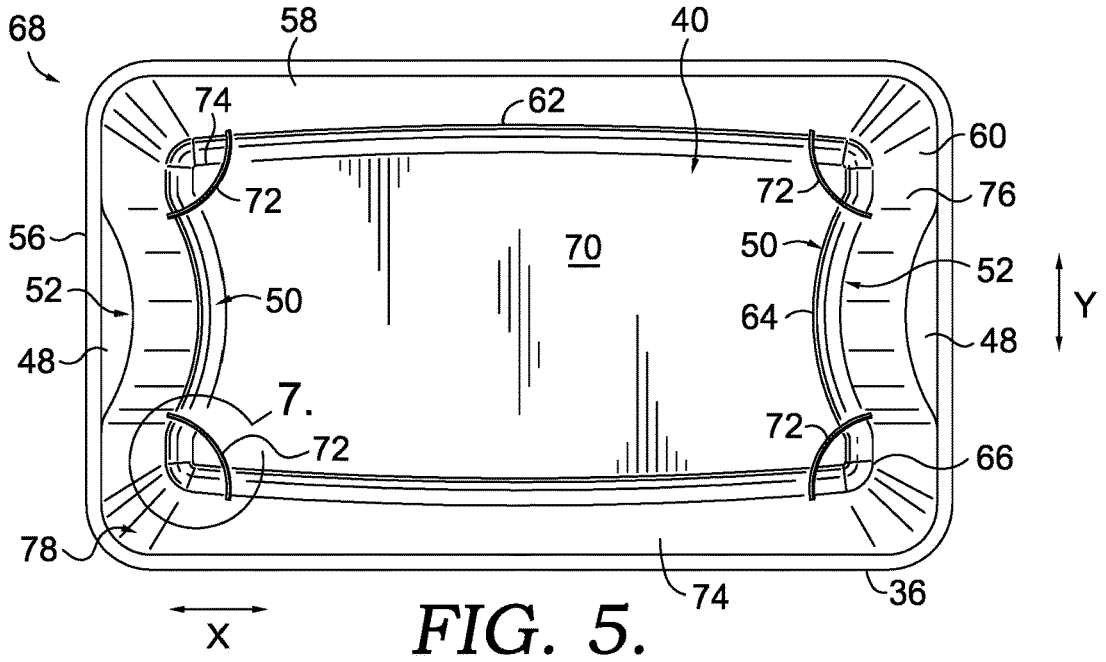
FIG. 5 depicts a top view of the storage container of FIG. 4, according to an embodiment of the invention.

With reference to FIG. 5, the internal view of a nesting storage container 68 includes an inside bottom surface 70 surrounded by internal stand-offs 72 (i.e., de-nesting features). In one embodiment, a tapered corner 74 associated with each internal stand-off 72 is positioned adjacent the tapered end wall surface 76 and the tapered side wall surface 78, surrounding the inside bottom surface 70 at a threshold distance from the upper edge 56 of the container body 36.

As depicted in FIG. 5, one internal stand-off 72 has been placed at each corner of the internal cavity 40. However, in accordance with aspects herein, this configuration is merely exemplary, and other placements of internal stand-offs 72 are considered to be within the scope of this disclosure. For example, any number of internal stand-offs 72 may be used to prevent a vacuum from forming within nested containers. Internal stand-offs 72 may be placed in one corner, two corners, three corners or all corners of the internal cavity 40. In single-corner configurations, the internal stand-off 72 may be placed in any corner of the internal cavity. Further, in two-corner configurations of internal stand-offs 72, the internal stand-offs may be placed at corners which are opposite from each other, or corners which are adjacent from each other. Still further, in three-corner configurations of internal stand-offs 72, the corner without the internal stand-off 72 need not be a specific corner of the internal cavity 40, but rather, may be any corner of the internal cavity 40.

Figure 6:
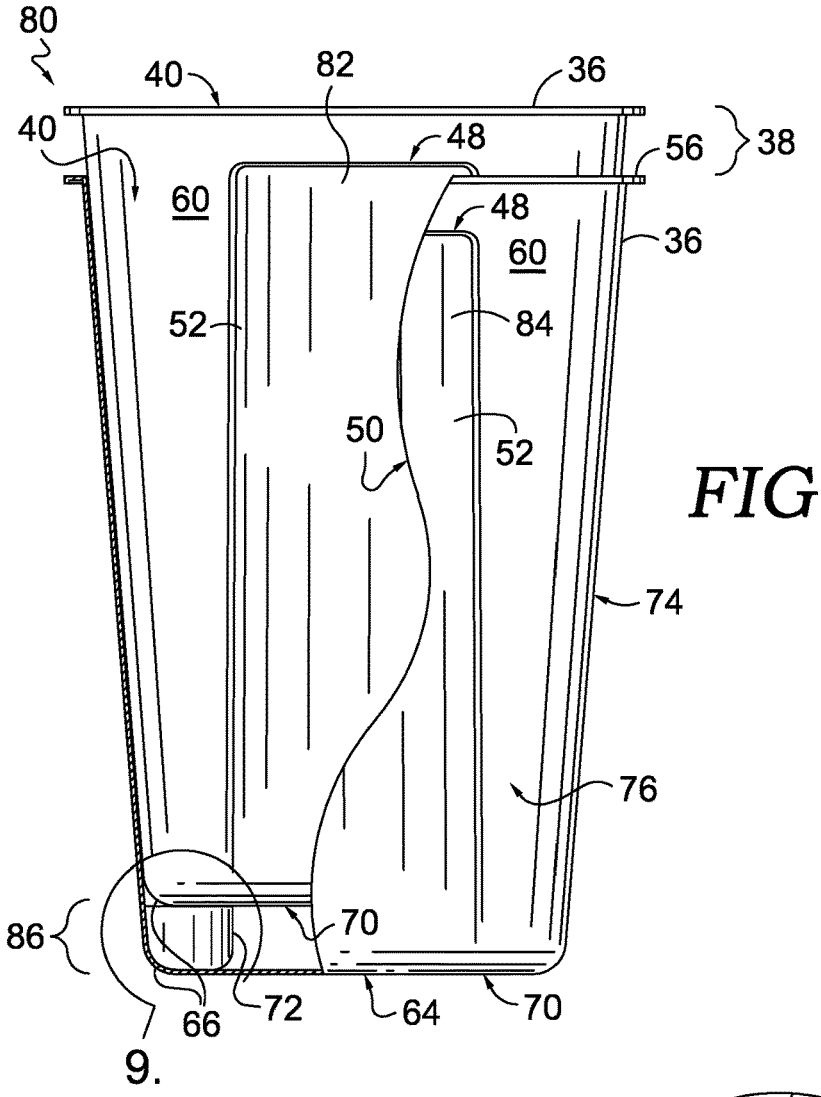
FIG. 6 is a side view of the pair of nested storage containers of FIG. 3, according to an embodiment of the invention.

In some embodiments, the internal stand-offs 72 may provide an arcuate structure between neighboring upright side walls 58 and end walls 60. In further aspects, the internal stand-offs 72 may be any configuration extending upward from the bottom surface 70 and into the internal cavity 40. In FIG. 6, a side view of a pair of nested storage containers 80 includes a cutaway portion of a lower container 84 receiving at least a portion of the upper container 82 inside the internal cavity 40. In this example, the internal stand-off 72 provides a height offset 86 between the bottom surface 70 of the lower container 84 and the bottom surface 70 of the upper container 82. In response to the offset against the internal stand-off 72, a corresponding height displacement 38 (less than that with a prior art storage container) may be used to characterize the separation of the two storage containers 36.

Figure 7:
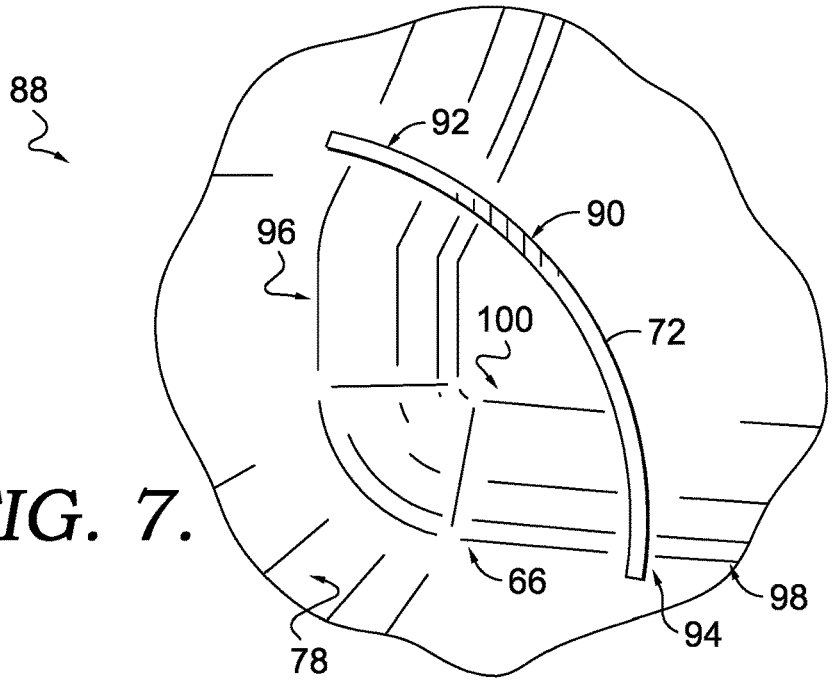
FIG. 7 is an enlarged, top view of a corner standoff portion of the storage container of FIG. 5, according to an embodiment of the invention.

In the enlarged view of FIG. 7, the stand-off feature 88 for separating the container bodies 36 of nested storage containers includes an internal standoff 72 with an arcuate structure 90 having a first end 92 opposite a second end 94. In some aspects, the internal standoff 72 may be any shape, angle, structure, curvature, or straight structure for bridging a distance between the end wall 96 and the side wall 98. As such, a de-nesting, standoff feature having a minimum structural characteristic, such as a particular dimension for supporting a particular weight of nested storage containers against each internal standoff 72, may be provided in or around a de-nesting location 100, such as the nesting location 100 of FIG. 7 oriented in a corner of the storage container 36, according to some embodiments of the invention.

Figure 8:
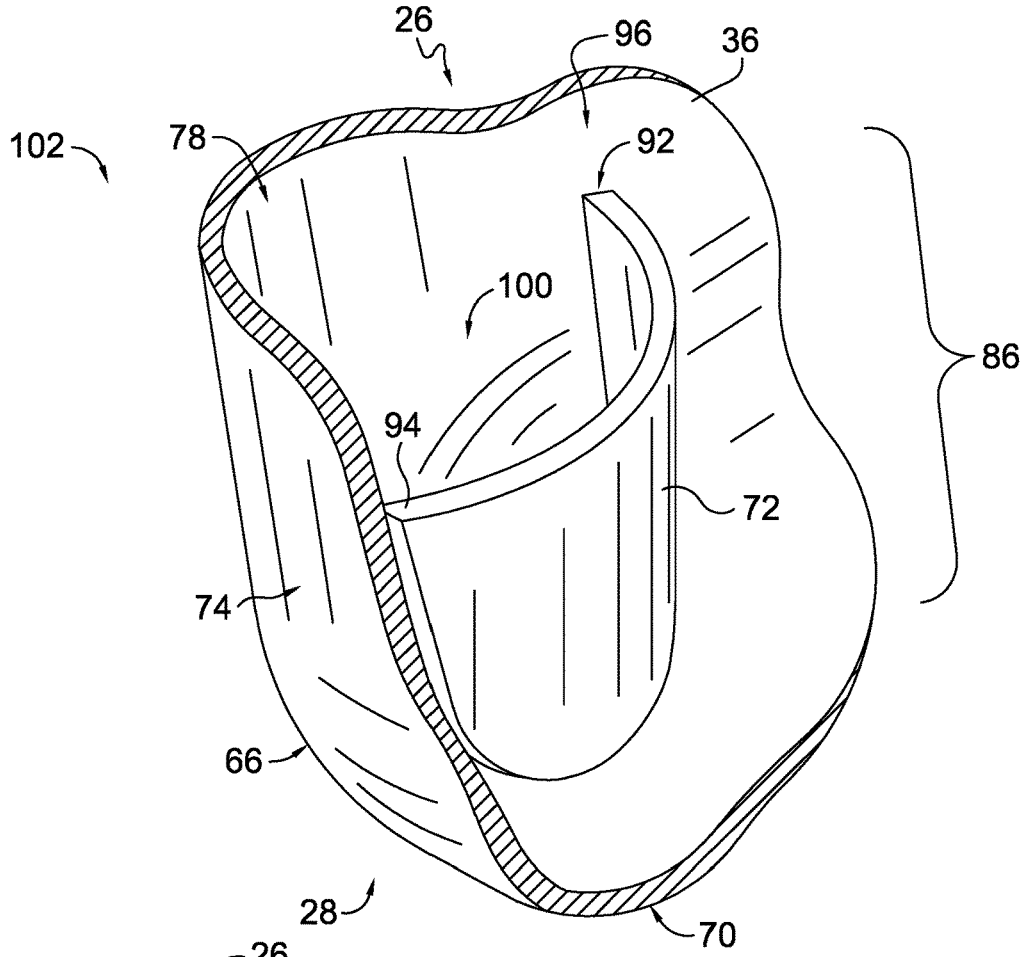
FIG. 8 is an enlarged, perspective view of the corner standoff portion of the storage container, according to an embodiment of the invention.
Figure 9:
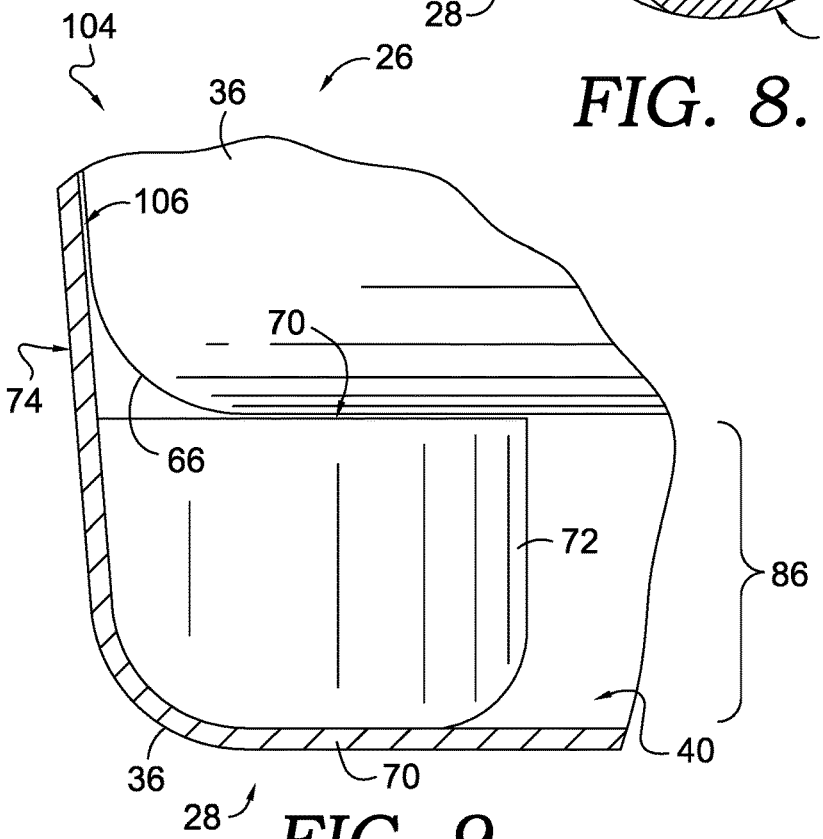
FIG. 9 is an enlarged, side view of a cutaway portion of FIG. 6, in accordance with an embodiment of the invention.

Shown from a different view, in FIG. 8, the corner portion 102 of the de-nesting location 100 depicts a threshold height 86 of the internal standoff 72, while in FIG. 9, an enlarged cutaway view of the nested containers 104 are provided to depict the resulting separation of the bottom surface 70 of one container relative to the bottom surface 70 of another container in close proximity. In some aspects, the internal standoff 72 features provide a requisite separation between bottom surfaces 70 of adjacent containers to prevent formation of a vacuum between at least a portion of one internal cavity 40 against at least a portion of the exterior of another storage container body 36. As such, in FIG. 9, a threshold separation 106 may be formed between two containers, nested together, such that at least a portion of the container body of one nesting storage container is separated by at least a portion of an air segment against another nesting storage container. In some aspects, the separability of adjacent storage containers may correspond to the threshold separation 106, the threshold height 86 of an internal standoff 72, a location/configuration of a handle 48, an orientation of a concave handle offset, a material density/flexibility of the storage container body 36, or a combination thereof.

Figure 10:
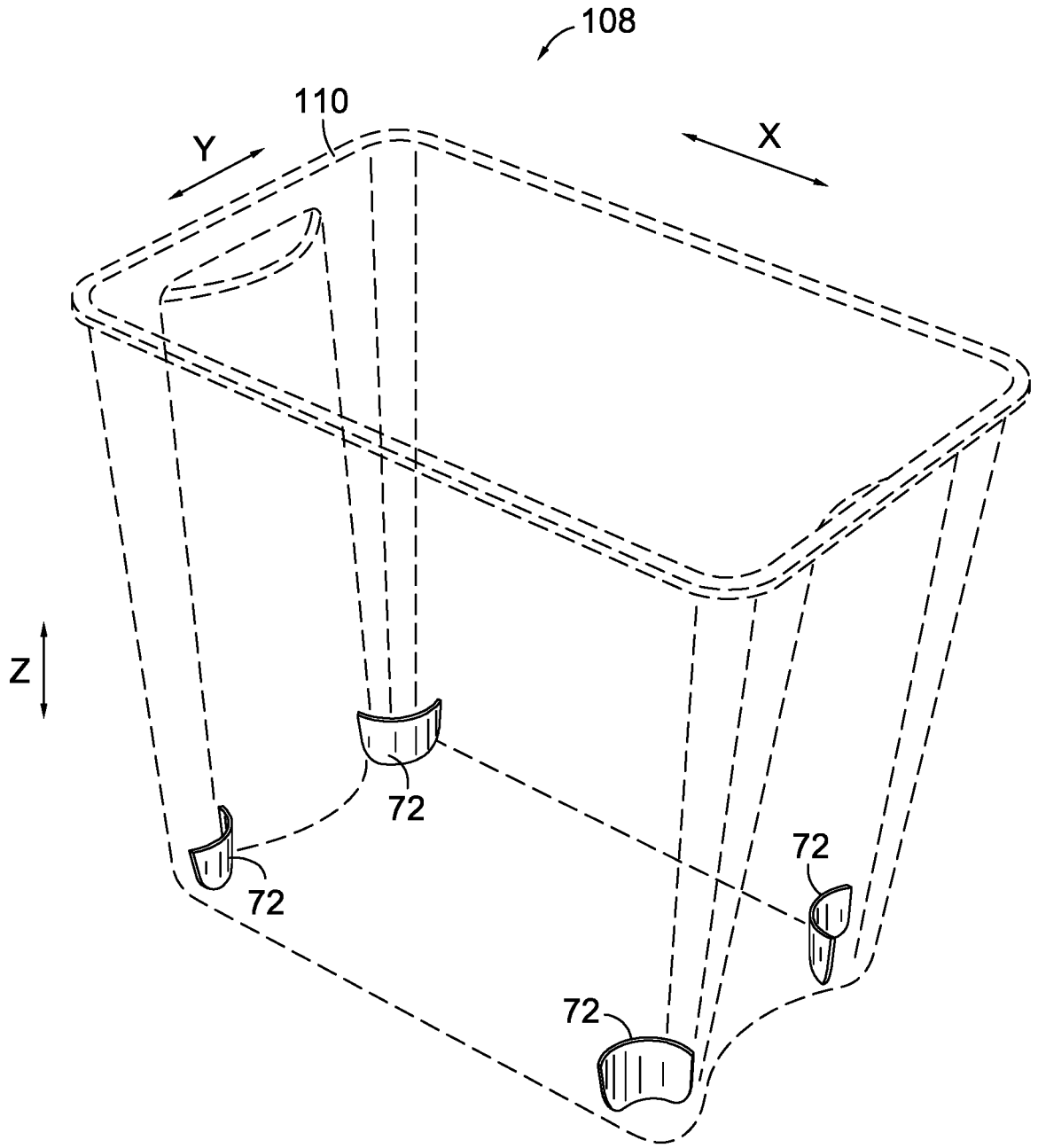
FIG. 10 is a perspective view of a nesting storage container in accordance with embodiments of the invention.
Figure 11:
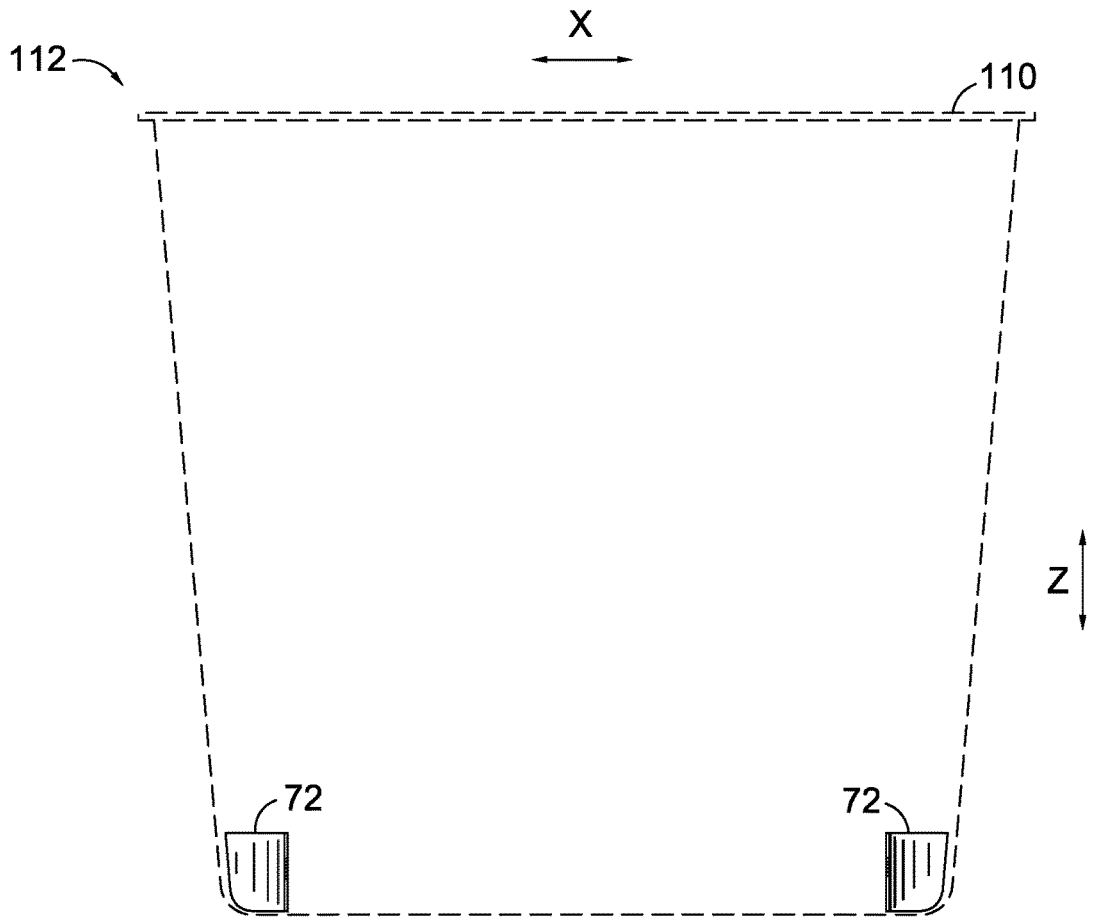
FIG. 11 is a front view of the nesting storage container of FIG. 10, in accordance with embodiments of the invention.
Figure 12:
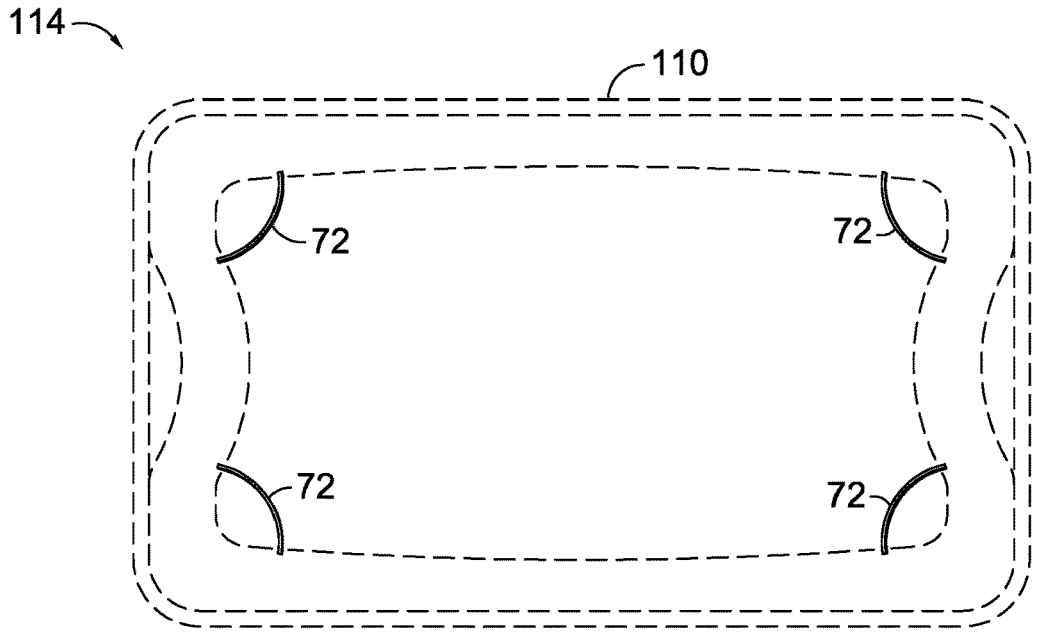
FIG. 12 is a top view of the nesting storage container of FIG. 10.
Figure 13:
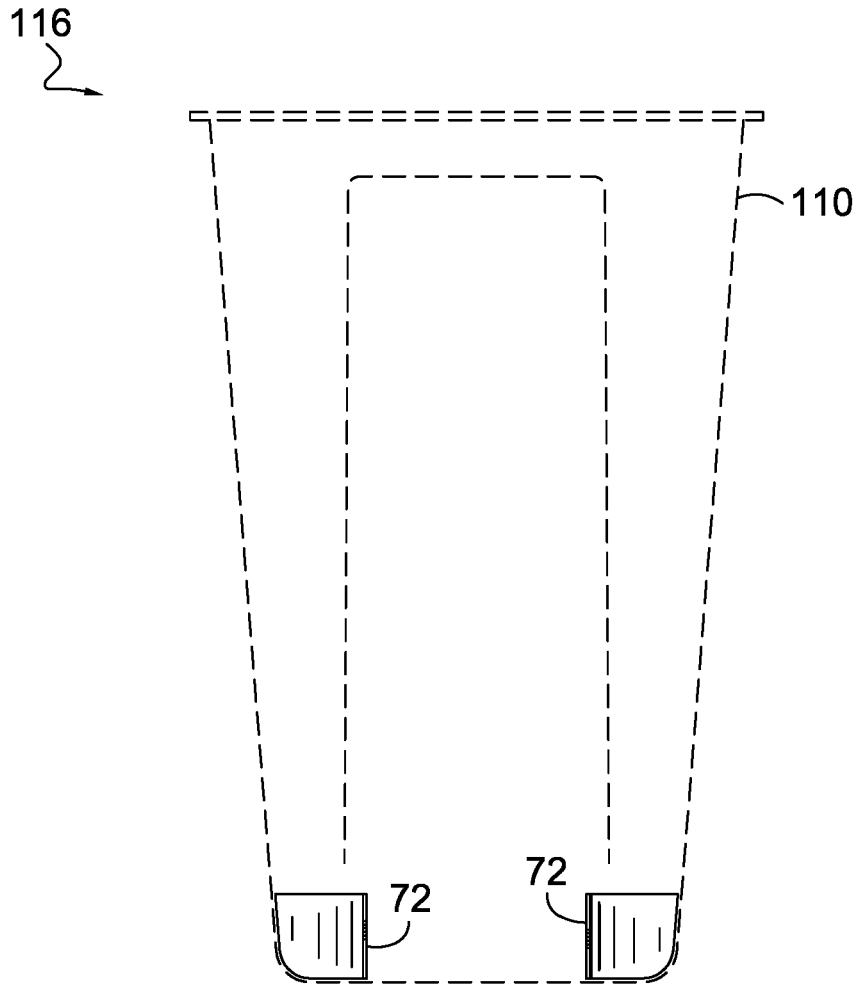
FIG. 13 is a side view of the nesting storage container of FIG. 10, in accordance with embodiments of the invention.

Turning next to FIG. 10, a perspective view 108 of a storage container includes a dashed container structure 110 having multiple arcuate internal standoffs 72. In FIGS. 11-13, the front view 112 of the dashed container structure 110, side view 114, and end view 116, provide a special relationship between the arcuate side structures on the container walls, and curvature of offset features along the interior, bottom of the container.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A nesting storage container comprising:

a plurality of upright walls and a lower wall surrounding an internal cavity, the plurality of upright walls having an upright wall height;

at least one de-nesting feature comprising:

a first arcuate surface coupled to two adjacent upright walls of the plurality of upright walls forming a first internal corner that is concave;

a second arcuate surface coupled to two adjacent upright walls of the plurality of upright walls forming a second internal corner that is concave; and an upper surface facing away from the lower wall of the plurality of upright walls, the upper surface having a width that is defined as the distance measured between the first arcuate surface and the second arcuate surface of the de-nesting feature;

wherein the first arcuate surface and the second arcuate surface extend perpendicularly from a bottom surface of the internal cavity, said de-nesting feature comprising a height that is between 5 and 20 percent of the upright wall height;

wherein the first arcuate surface and the second arcuate surface are convex with respect to the first internal corner and the second internal corner;

wherein a surface area of the upper surface is partially defined by the width of the upper surface; and at least one handle having a concave handle offset oriented along a vertical axis of at least a portion of at least one of the plurality of upright walls.

2. The storage container of claim 1, wherein the plurality of upright walls comprises four upright walls surrounding the internal cavity, each upright wall coupled to at least two adjacent upright walls along opposing vertical sides.

3. The storage container of claim 1, wherein the arcuate extension is coupled at a first end to a first upright wall of the plurality of upright walls and coupled at a second end to a second upright wall of the plurality of upright walls.

4. The storage container of claim 1, wherein the concave handle offset is displaced a threshold handle distance from an opening edge of the storage container device such that a handle grip is provided between the opening edge and the top edge of the concave handle offset.

5. The storage container of claim 1, wherein the internal cavity comprises dimensions configured to receive a separate storage container having a corresponding plurality of upright walls and a corresponding handle offset.

6. A stackable storage container comprising:

a plurality of vertical walls and a lower wall surrounding a cavity, wherein a first wall of the plurality of vertical walls is directly adjacent a second wall of the plurality of vertical walls, the plurality of vertical walls having a vertical wall height;

at least one de-nesting feature comprising:

a first arcuate surface coupled to two adjacent upright walls of the plurality of upright walls forming a first internal corner that is concave;

a second arcuate surface coupled to two adjacent upright walls of the plurality of upright walls forming a second internal corner that is concave; and an upper surface facing away from the lower wall of the plurality of upright walls, the upper surface having a width that is defined as the distance measured between the first arcuate surface and the second arcuate surface of the de-nesting feature;

wherein the first arcuate surface and the second arcuate surface extend perpendicularly from a bottom surface of the internal cavity, said at least one de-nesting feature comprising a height that is coupled to the first wall and the second wall, and a width that is defined as measured between the first arcuate surface and the second arcuate surface of the de-nesting feature;

wherein the height of the de-nesting feature is less than half of the vertical wall height;

wherein the first arcuate surface and the second arcuate surface are convex with respect to the first internal corner and the second internal corner;

wherein a surface area of the upper surface is partially defined by the width of the upper surface; and at least one handle comprising a concave handle structure along at least a portion of the first wall.

7. The stackable storage container of claim 6, wherein upon receiving a separate stackable container inside the cavity, the at least one de-nesting feature is configured to displace the separate stackable container from an interior portion of the cavity.

8. The stackable storage container of claim 6, wherein the at least one handle comprises a handle grip portion adjacent the concave handle structure, said handle grip portion comprising a portion of the first wall between an opening edge of the stackable storage container and a top edge of the concave handle offset.

9. A nesting storage container system for removably coupling multiple storage containers, the system comprising:

a first nesting container having a first plurality of vertical walls and a lower wall surrounding a first internal cavity and a first bottom surface, said first nesting container comprising a first container interior and a first container exterior, the first plurality of vertical walls further comprising a first vertical wall height, wherein the first container exterior comprises a first handle having a vertical handle offset oriented concave to the first internal cavity on a first wall of the first plurality of vertical walls, wherein the first container interior comprises a first de-nesting feature comprising:

a first arcuate surface coupled to two adjacent upright walls of the plurality of upright walls forming a first internal corner that is concave;

a second arcuate surface coupled to two adjacent upright walls of the plurality of upright walls forming a first internal corner that is concave; and an upper surface facing away from the lower wall of the plurality of upright walls, the upper surface having a width that is defined as the distance measured between the first arcuate surface and the second arcuate surface of the de-nesting feature;

wherein the first arcuate surface and the second arcuate surface extend perpendicularly from the first bottom surface of the first internal cavity, said first de-nesting feature comprising a height that is less than half of the first vertical wall height, and a width that is defined as measured between the first arcuate surface and the second arcuate surface of the de-nesting feature;

wherein the first arcuate surface and the second arcuate surface are convex with respect to the first internal corner and the second internal corner;

wherein a surface area of the upper surface is partially defined by the width of the upper surface; and wherein the first container interior is configured to mate to a second container exterior of a second nesting container.

10. The nesting storage container system of claim 9, wherein the first de-nesting feature of the first container interior is positioned proximate an interior surface corresponding to the vertical handle offset of the first container interior.

11. The nesting storage container system of claim 9, wherein the second nesting container comprises:

a second plurality of vertical walls surrounding a second internal cavity and a second bottom surface of a second container interior, wherein the second container exterior comprises a second handle having a vertical handle offset oriented concave to the second internal cavity on a second wall of the second plurality of vertical walls, and wherein the second container interior comprises a second de-nesting feature on the second bottom surface of the second internal cavity, said second de-nesting feature coupled to at least one of the second plurality of vertical walls.

12. The nesting storage container system of claim 9, wherein upon positioning the second nesting container inside the first internal cavity of the first nesting container, the second bottom surface is spaced a threshold distance from the first bottom surface of the first nesting container based on one or more of the following:

(1) a height of the first nesting feature;

(2) a dimension of the vertical handle offset of each of the first handle and the second handle; and (3) a threshold spacing between the first plurality of vertical walls and the second plurality of vertical walls.

* * * * *